US009945391B2

(12) United States Patent
Hausmann

(10) Patent No.: US 9,945,391 B2
(45) Date of Patent: Apr. 17, 2018

(54) DIFFUSER COLLAR

(71) Applicant: TRANE INTERNATIONAL INC., Piscataway, NJ (US)

(72) Inventor: John Scott Hausmann, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 321 days.

(21) Appl. No.: 14/669,909

(22) Filed: Mar. 26, 2015

(65) Prior Publication Data

US 2015/0275918 A1 Oct. 1, 2015

Related U.S. Application Data

(60) Provisional application No. 61/971,213, filed on Mar. 27, 2014.

(51) Int. Cl.
*F04D 29/54* (2006.01)
*F04D 19/00* (2006.01)

(52) U.S. Cl.
CPC ..... *F04D 29/542* (2013.01); *F04D 19/002* (2013.01); *F04D 29/541* (2013.01); *Y10T 29/49245* (2015.01)

(58) Field of Classification Search
CPC ..... F04D 19/00; F04D 19/002; F04D 29/541; F04D 29/542; Y10T 29/49245
See application file for complete search history.

(56) References Cited

U.S. PATENT DOCUMENTS 1,725,085 A 8/1929 Johnson
2,653,757 A * 9/1953 Segalman ..... F04D 29/703 415/148

(Continued)

FOREIGN PATENT DOCUMENTS

EP 0387987 A2 * 9/1990 ..... F04D 29/542
JP 08189671 7/1996

(Continued)

OTHER PUBLICATIONS

International Search Report and Written Opinion for International Application PCT/US2015/022779, dated Jul. 14, 2015, 15 pgs.

*Primary Examiner* — Woody Lee, Jr.
*Assistant Examiner* — Elton Wong
(74) *Attorney, Agent, or Firm* — Hamre, Schumann, Mueller & Larson, P.C.

(57) ABSTRACT

A fan assembly and a method of assembling a diffuser collar in the fan assembly are disclosed. The fan assembly includes an impeller including a plurality of blades. The impeller has an impeller diameter. A duct is configured to receive an outflow provided by the impeller. The duct has a duct exit diameter that is larger than the impeller diameter. The fan assembly further includes a diffuser collar extending from the impeller toward a duct exit. The diffuser collar is configured and arranged to radially expand the outflow provided by the impeller. The diffuser collar has a first diameter at a first edge disposed a first distance from the impeller. A contour extends from the first edge toward a second edge having a second diameter. The second edge is disposed a second distance from the impeller. The first distance is smaller than the second distance, the first diameter is smaller than the second diameter, and the first and second diameters are smaller than the duct exit diameter.

14 Claims, 3 Drawing Sheets

(56) References Cited

U.S. PATENT DOCUMENTS

| | | | | |
|---|---|---|---|---|
| 2,873,908 | A | 2/1959 | Powers | |
| 3,019,965 | A | 2/1962 | Lyman | |
| 3,531,221 | A | 9/1970 | Herber et al. | |
| 5,967,748 | A | 10/1999 | Jang | |
| 6,027,307 | A | 2/2000 | Cho et al. | |
| 6,503,060 | B1 | 1/2003 | Kamada et al. | |
| 6,572,333 | B2 | 6/2003 | Fujinaka | |
| 7,004,732 | B2 | 2/2006 | Cho et al. | |
| 7,334,988 | B2 * | 2/2008 | Horng | F04D 29/667 415/211.2 |
| 2003/0138321 | A1 * | 7/2003 | Somahara | F04D 29/703 415/121.2 |
| 2008/0292453 | A1 * | 11/2008 | Hsu | F04D 25/0613 415/182.1 |
| 2012/0039731 | A1 * | 2/2012 | Sadi | F04D 29/164 417/423.7 |
| 2014/0119892 | A1 * | 5/2014 | Mornan | F04D 29/542 415/122.1 |
| 2015/0330411 | A1 * | 11/2015 | Heli | F04D 29/542 415/208.2 |

FOREIGN PATENT DOCUMENTS

| | | |
|---|---|---|
| JP | 08210665 | 8/1996 |
| KR | 10-0643690 | 11/2006 |
| KR | 10-2014-0015945 | 2/2014 |

* cited by examiner

DIFFUSER COLLAR

FIELD

This disclosure relates generally to an axial fan diffuser. More specifically, the disclosure relates to an axial fan diffuser for use in a heating, ventilation, and air conditioning (HVAC) system.

BACKGROUND

A heating, ventilation, and air conditioning (HVAC) system typically includes a compressor, a condenser, an expansion device, and an evaporator, combined to form a refrigeration circuit. The HVAC system can include a condenser fan configured to draw air over the condenser. A condenser fan is often placed within a duct. The outlet of the duct generally includes a grille, which serves to prevent anything from reaching the moving parts of the condenser fan (e.g., a body part such as a finger, foreign substances such as leaves and sticks, or the like).

SUMMARY

This disclosure relates generally to an axial fan diffuser. More specifically, the disclosure relates to an axial fan diffuser for use in an HVAC system.

In some embodiments, an axial fan can be a condenser fan in a refrigeration unit. A refrigeration unit can, for example, include an air-cooled water chiller (e.g., a compressor, condenser, expansion device, and evaporator), an air-cooled condenser unit (e.g., a compressor, condenser, expansion device, and evaporator), or other similar unit in an HVAC system including one or more axial fans. The axial fan can be installed within a duct. The duct can include a diffuser collar. The diffuser collar can control an expansion of an outflow from the axial fan from an outflow side of the axial fan to the duct exit.

In some embodiments, an axial fan including a diffuser collar can have an improved static efficiency over an axial fan without a diffuser collar. Fan performance can, for example, be measured on a wind tunnel to obtain fan pressure rise and flow rate, which along with input power can be used to calculate static efficiency. In one embodiment, a static efficiency of an axial fan including a diffuser collar tested in a wind tunnel can be between about 5 and about 10 percent higher than an axial fan without a diffuser collar tested in a wind tunnel. It is to be appreciated that the stated range is exemplary and that efficiency improvements can vary beyond the stated range.

In one embodiment, a fan assembly can include an impeller having a plurality of blades, a duct configured to receive an outflow provided by the impeller, and a diffuser collar extending from the impeller toward a duct exit. The diffuser collar has a variable diameter and can be configured to radially expand the outflow provided by the impeller.

In one embodiment, a diffuser collar can have a smaller diameter at the outflow side of an axial fan than a diameter of a duct in which the axial fan is installed. The diffuser collar can expand the outflow from the axial fan to a slower rate than the duct alone. In some embodiments, modifying the expansion rate of the outflow can improve the efficiency of the axial fan by, for example, increasing pressure rise through diffusion of the outflow.

In another embodiment, a plurality of diffuser collars are concentrically arranged to control an expansion of an outflow from an axial fan. The plurality of diffuser collars can include a plurality of vane diffusers. In some embodiments, a plurality of diffuser collars and a plurality of vane diffusers can reduce an amount of the outflow recirculating to the inlet side of the axial fan. In some embodiments, reducing recirculation of the outflow can improve the efficiency of the axial fan. For example, the plurality of vane diffusers can increase the axial velocity of the outflow provided by the axial fan, thereby allowing more air to be drawn without increasing the speed of the axial fan. The plurality of vane diffusers can also decrease a circumferential velocity of the outflow. Reducing recirculation of the outflow can also reduce a sound level (e.g., audible volume) of the axial fan.

In another embodiment, a diffuser collar can be installed in a duct including a grille. In some embodiments, a plurality of concentrically arranged diffuser collars can be installed in a duct including a grille. In other embodiments, a plurality of diffuser collars and a plurality of vane diffusers can be installed in a duct in place of a grille.

A fan assembly and a method of assembling a diffuser collar in the fan assembly are disclosed. The fan assembly includes an impeller including a plurality of blades. The impeller has an impeller diameter. A duct is configured to receive an outflow provided by the impeller. The duct has a duct exit diameter that is larger than the impeller diameter. The fan assembly further includes a diffuser collar extending from the impeller toward a duct exit. The diffuser collar is configured and arranged to radially expand the outflow provided by the impeller. The diffuser collar has a first diameter at a first edge disposed a first distance from the impeller. A contour extends from the first edge toward a second edge having a second diameter. The second edge is disposed a second distance from the impeller. The first distance is smaller than the second distance, the first diameter is smaller than the second diameter, and the first and second diameters are smaller than the duct exit diameter.

A method of assembling a diffuser collar apparatus in a fan system is described. The method includes providing an axial fan having a duct with a duct exit of a larger diameter than an impeller of the axial fan; and providing a diffuser collar at a duct exit having a variable diameter for radially expanding an outflow from the impeller of the axial fan to the duct exit.

A method of controlling an outflow of an axial fan is described. The method includes providing an axial fan having a duct with a duct exit of a larger diameter than an impeller of the axial fan; and providing a plurality of concentrically spaced diffuser collars having variable diameters at the duct exit for radially expanding an outflow from the impeller of the axial fan out of the duct exit.

BRIEF DESCRIPTION OF THE DRAWINGS

References are made to the accompanying drawings that form a part of this disclosure, and which illustrate embodiments in which the systems and methods described in this specification may be practiced.

Like reference numbers represent like parts throughout.

DETAILED DESCRIPTION

Figure 1:
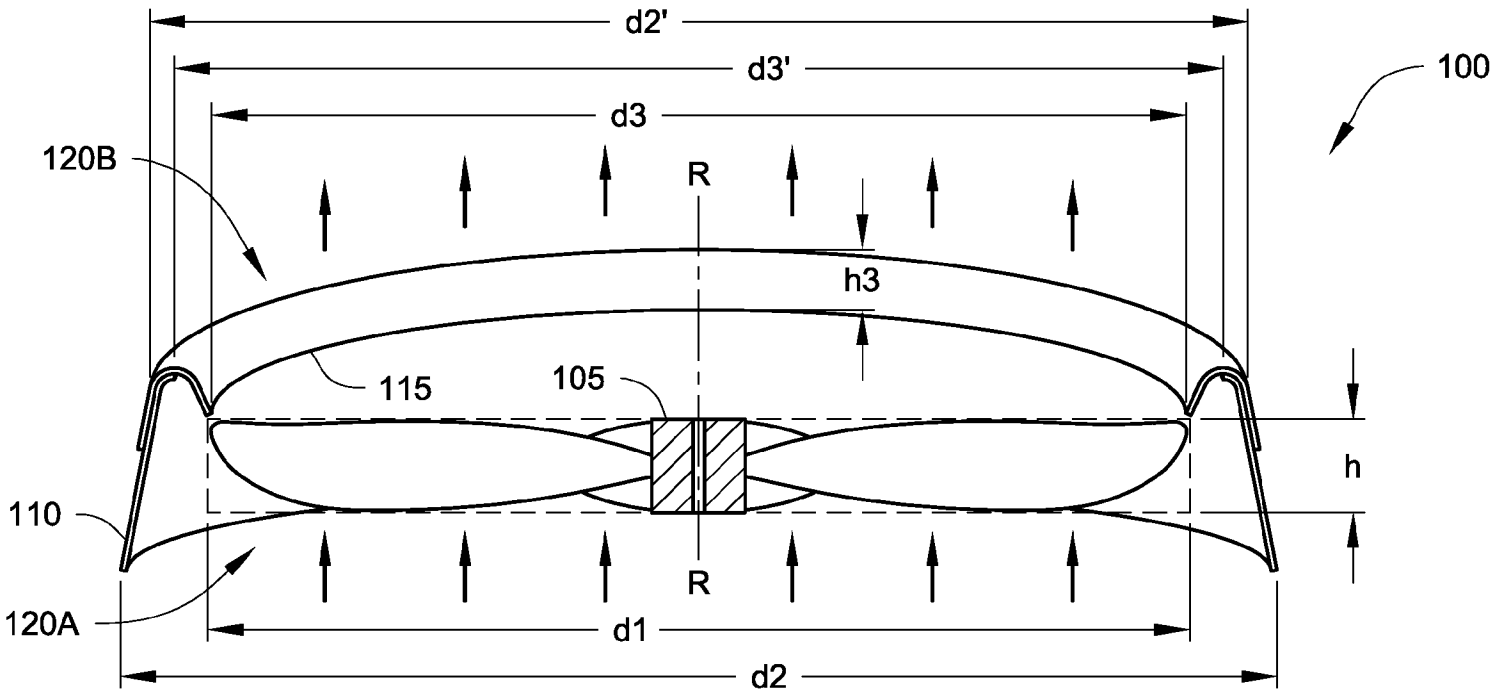
FIG. 1 illustrates an axial fan system including a diffuser collar, according to some embodiments.

This disclosure relates generally to an axial fan diffuser. More specifically, the disclosure relates to an axial fan diffuser for use in an HVAC system.

A refrigeration unit in an HVAC system generally includes a compressor, a condenser, an expansion device, an evaporator, and a condenser fan (e.g., an axial fan installed within a duct). The refrigeration unit can, for example, be an air-cooled water chiller, an air-cooled condenser unit, or other similar unit in an HVAC system including one or more axial fans. The condenser fan is configured to draw airflow over the condenser in the refrigeration unit.

In some embodiments, a refrigeration unit can include a plurality of condenser fans. The condenser fan is generally installed within a duct. The duct modifies the outflow from the condenser fan. The configuration of the duct (e.g., height, diameter, or the like), at least in part, determines the efficiency of the condenser fan. A grille is typically installed at the duct exit. The grille serves as a guard, preventing contact with the condenser fan and its rotating parts (e.g., for safety, to prevent damage to the condenser fan, or the like). The duct is typically of a larger diameter than an impeller of the condenser fan, which can cause the outflow to decelerate as it expands from the outflow side of the impeller to the duct exit. A portion of the outflow can recirculate because of the larger diameter of the duct. Recirculation of the outflow can increase the sound level of the condenser fan. In some embodiments, the audible volume of the condenser fan can particularly be an issue if the refrigeration unit is operating on or near a building having a maximum sound level limit (e.g., a sound ordinance, a user preference, or the like). Recirculation of the outflow can also adversely impact the efficiency of the condenser fan.

Embodiments of this disclosure are directed to a diffuser collar to modify an outflow from an axial fan. Some embodiments include a plurality of diffuser collars and a plurality of vane diffusers to modify the outflow from the axial fan. Modifying the outflow from the axial fan can increase the efficiency of the axial fan as compared to a system not including the diffuser collar and/or vane diffusers. In some embodiments, an axial fan including a diffuser collar can have an improved static efficiency over an axial fan without a diffuser collar. In some embodiments, fan performance can be measured on a wind tunnel to obtain fan pressure rise and flow rate, which along with input power can be used to determine static efficiency. In one embodiment, a static efficiency of an axial fan including a diffuser collar tested in a wind tunnel can be between about 5 and about 10 percent higher than an axial fan without a diffuser collar tested in a wind tunnel. It is to be appreciated that the stated range is exemplary and that efficiency improvements can vary beyond the stated range. In some embodiments, the diffuser collar can reduce the sound level of the axial fan during operation.

A condenser fan in a refrigeration unit is discussed by way of example in this specification. The embodiments, aspects, and concepts described within this specification may apply to axial fans other than a condenser fan in a refrigeration unit. Examples of additional applications include, but are not limited to, exhaust fans, circulation fans, radiator fans, cooling fans (e.g., for electronics or the like), or the like.

In one embodiment, a fan assembly can include an impeller having a plurality of blades, a duct configured to receive an outflow provided by the impeller, and a diffuser collar extending from the impeller toward a duct exit. The diffuser collar has a variable diameter and can be configured to radially expand the outflow provided by the impeller.

FIG. 1 illustrates an axial fan system 100 including a diffuser collar 115, according to some embodiments. The axial fan system 100 includes an impeller 105, a duct 110, and the diffuser collar 115. The axial fan system 100 can include fewer or additional components, according to some embodiments. For example, the axial fan system 100 can include an orifice (not shown in FIG. 1) on an inflow side 120A of the impeller 105 that reduces the size of the duct 110 on the inflow side 120A of the impeller 105. The axial fan system 100 generally represents a condenser fan in a refrigeration unit of an HVAC system. The axial fan system 100 can represent other axial fan systems so long as the impeller 105 is located within a duct similar to the duct 110.

The impeller 105 includes a plurality of blades installed on a central hub. The impeller 105 can also include a band at the outer periphery of the blades. This band is represented as a dashed box around the impeller 105 in FIG. 1. The impeller 105 can be driven by a motor. The impeller has an axis of rotation illustrated by line R-R. A shaft (not shown in FIG. 1) connects the motor (not shown in FIG. 1) and the impeller 105 and can be located along the line R-R such that the shaft and the impeller 105 have the same axis of rotation. It is to be appreciated that the configuration of the impeller 105, the motor, and the shaft can vary according to an application of the fan. For example, in some embodiments the impeller 105 can be driven by a belt, driven directly by an engine, driven by an electric motor, or the like. The design of the impeller 105 can vary and may, for example, be determined by the application in which the axial fan is to be used. For example, the impeller 105 can have different designs depending on the type of refrigeration unit (or whether the application is for an axial fan other than in a refrigeration unit) in which the axial fan system 100 is used. For example, the impeller 105 can vary based on whether the refrigeration unit is an air-cooled water chiller or an air-cooled condenser unit. The impeller 105 can also vary based on the design of a particular refrigeration unit (e.g., size, capacity, or the like).

The impeller 105 has a diameter d1 and a height h. The diameter d1 can, for example, be measured from blade tip to blade tip in a straight line that is perpendicular to the axis R-R. If the impeller 105 includes a band at the outer periphery of the blades, the diameter d1 can be the diameter of the band in such an embodiment. The diameter d1 is smaller than the diameter of the duct 110 on the inflow side 120A. The diameter d1 can be smaller than the diameter of the duct 110 on the outflow side 120B as well. The diameter d1 is smaller than the diameter of the duct 110 at the location of the impeller 105 corresponding to the outflow side 120B. Because the diameter of the duct 110 is larger than the diameter d1 of the impeller 105, the outflow from the impeller 105 can expand rapidly. The rapid expansion can cause recirculation of a portion of the outflow to the inflow side 120A of the impeller 105. The recirculation can reduce the efficiency of the axial fan system 100 and increase a sound level of the axial fan system 100.

The duct 110 duct has a diameter d2 on the inlet side 120A. The outlet side 120B of the duct 110 has a diameter d2'. The diameter d2 is greater than the diameter d1 of the impeller 105. Because the diameter d2 is greater than the diameter d1 of the impeller 105, the outflow may expand rapidly, which can cause recirculation of the outflow and can reduce the efficiency of the axial fan system 100.

Disposed near the outflow side 120B of the impeller 105 is the diffuser collar 115. A diameter d3 of the diffuser collar 115 disposed near the outflow side 120B of the impeller 105 is about the same as the diameter d1 of the impeller 105. In some embodiments, the diameter d3 can be slightly smaller than the diameter d1 of the impeller 105 such that when the impeller 105 spins it rubs away a portion of the diffuser collar 115. This can, for example, provide a tighter fit between the diffuser collar 115 and the impeller 105. The diffuser collar 115 can be made of, for example, plastic. It is to be appreciated that the diffuser collar 115 can be made of materials other than plastic, such as, but not limited to, sheet metal or the like.

The diffuser collar 115 has a height h3 and a diameter d3' on the exit side of the duct 110. The diameter d3' is generally larger than the diameter d3. The contour of the diffuser collar 115 varies from the outflow side 120B of the impeller to the exit of the duct 110. In some embodiments, the contour is linear. In other embodiments, the contour can be non-linear. The variation in diameter is generally designed to expand the outflow of the impeller 105 at a desired rate to control an axial component and a circumferential component of the outflow velocity. The height h3 of the diffuser collar 115 is about the same as the distance from the outflow side 120B of the impeller 105 to the exit of the duct 110. The variation of the diameter of the diffuser collar 115 can be determined based on the height h3. For example, as the height h3 increases, the effectiveness of varying the diameter may increase. Similarly, as the height h3 increases, the variation between the diameters d3, d3' of the diffuser collar 115 may be such that the contour of the diffuser collar 115 is increasingly non-linear.

A grille (not shown in FIG. 1) can be included at the exit of the duct 110. The grille can be a structure for preventing body parts and other foreign substances from coming into contact with the impeller 105. The diffuser collar 115 can be securely connected to the grille, according to some embodiments. In other embodiments, the diffuser collar 105 can be combined with additional, concentrically arranged diffuser collars 115 and a plurality of vane diffusers (e.g., vane diffusers 305 shown in FIG. 3) to form a grille structure. In such an embodiment, a separate grille may not be included. An embodiment having a plurality of concentrically arranged diffuser collars 115 and a plurality of vane diffusers is described in further detail in accordance with FIG. 3 below.

Figure 2:
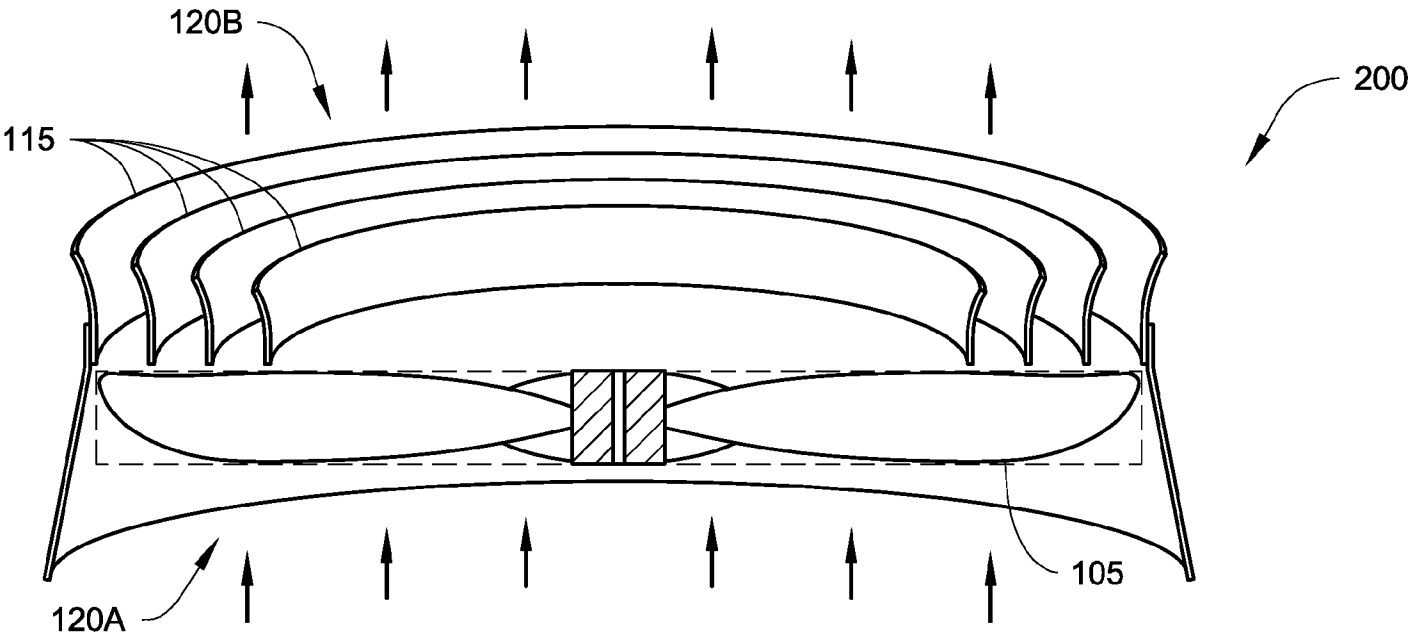
FIG. 2 illustrates an axial fan system including a plurality of concentrically arranged diffuser collars, according to other embodiments.

FIG. 2 illustrates an axial fan system 200 including a plurality of concentrically arranged diffuser collars 115, according to some embodiments. The axial fan system 200 includes the plurality of concentrically arranged diffuser collars 115 disposed on the outflow side 120B of the impeller 105, according to some embodiments. Aspects of FIG. 2 can be the same as or similar to aspects of FIG. 1.

The axial fan system 200 includes the impeller 105 as described in accordance with FIG. 1. The axial fan system 200 is configured to be installed within the duct 110 (FIG. 1). The plurality of diffuser collars 115 can control the expansion rate of the outflow and accordingly increase the efficiency of the axial fan system 200. Further, because of the increased efficiency, the speed of the impeller 105 can be reduced without reducing the outflow of the axial fan system 200. As a result, the sound level of the axial fan system 200 can be reduced as well.

Each of the plurality of diffuser collars 115 has a first diameter disposed near the outflow side of the impeller 105 and a second diameter disposed near the exit of the duct 110 (as shown and described for the diffuser collar 115 in accordance with FIG. 1). The plurality of diffuser collars 115 can be designed based on the location in relation to the duct 110. That is, the diffuser collar 115 located at the periphery of the impeller 105 can have a different contour (e.g., different variation between the first and second diameters) than the diffuser collar located near the central axis of the impeller 105. In some embodiments, one or more of the plurality of diffuser collars 115 disposed near the central axis of the impeller 105 can have the second diameter be smaller than the first diameter. This can, for example, direct some of the relatively higher velocity outflow (e.g., near a periphery region of the impeller 105) toward the relatively lower velocity region (e.g., near the central axis of the impeller 105). In some embodiments, the design of the plurality of diffuser collars 115 can be substantially similar. That is, in some embodiments the contours of the plurality of diffuser collars 115 is substantially similar.

As described in accordance with FIG. 1, the plurality of diffuser collars 115 can be mounted to a grille disposed at the exit of the duct 110.

Figure 3:
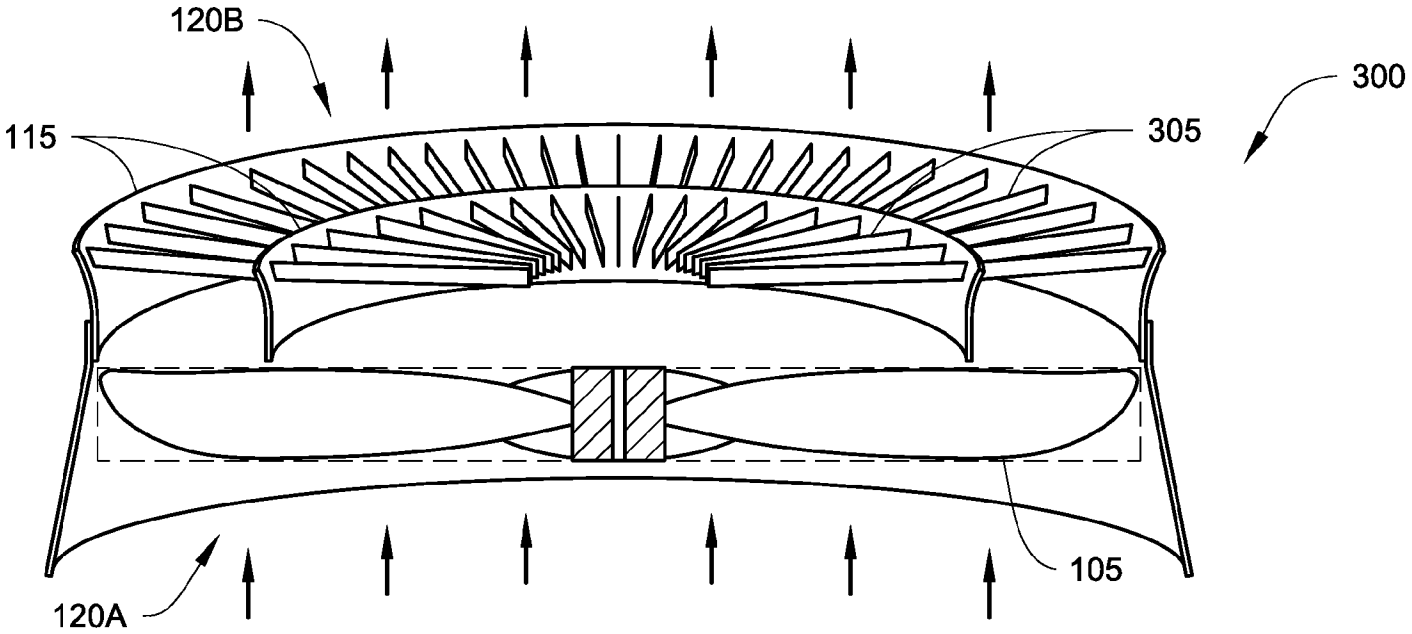
FIG. 3 illustrates an axial fan system including a plurality of concentrically arranged diffuser collars and a plurality of vane diffusers for an axial fan, according to some embodiments.

FIG. 3 illustrates an axial fan system 300 including a plurality of concentrically arranged diffuser collars 115 and a plurality of vane diffusers 305 for an axial fan, according to some embodiments. The axial fan system 300 includes the plurality of concentrically arranged diffuser collars 115 on the outflow side 120B of the impeller 105. The axial fan system 300 also includes a plurality of vane diffusers 305. Aspects of FIG. 3 can be the same as or similar to aspects of FIGS. 1-2.

The plurality of vane diffusers 305 is disposed between the concentrically arranged plurality of diffuser collars 115. The plurality of vane diffusers 305 extend substantially radially from the hub of the impeller 105 toward the duct (e.g., the duct 110 of FIG. 1). In some embodiments, the plurality of vane diffusers 305 may have a different contour, such that the vane diffusers extend outward but have some curvature, either in the direction of rotation of the impeller 105 or against the direction of rotation of the impeller 105.

The vane diffusers 305 are configured to decrease a circumferential component of the velocity of the outflow and increase an axial component of the velocity of the outflow. As a result, the vane diffusers 305 can increase the outflow of the impeller 105 without increasing the speed of the impeller 105. In some embodiments, the vane diffusers 305 allow the axial fan speed to be decreased without affecting the cooling capacity of the refrigeration unit. Accordingly, the speed of the impeller 105 can be reduced, which can, in some embodiments, decrease the sound level of the axial fan system 300.

The contour of the vane diffusers 305 can be designed to control the expansion of the outflow in the axial direction. The number and/or spacing of the vane diffusers 305 can be varied based on the location as well. For example, there may be more vane diffusers 305 at the peripheral region of the impeller 105 than there are in the central region of the impeller 105 (e.g., near the axis of rotation of the impeller 105).

The plurality of vane diffusers 305 and the plurality of concentrically arranged diffuser collars 115 can take the place of the grille at the exit of the duct 110. Accordingly, the arrangement of the vane diffusers 305 and the diffuser collars 115 is such that body parts and other foreign substances are prevented from coming into contact with the impeller 105. The arrangement may also be designed to withstand a load directed toward the impeller (e.g., if an object is placed on the vane diffuser 305 and diffuser collar 115 arrangement, the object does not cause either the vane diffusers 305 or the diffuser collars 115 to come into contact with the impeller 105).

ASPECTS

It is noted that any of aspects 1-12 below can be combined with any of aspects 13-14, 15-16, and 17-18. It is also to be noted that any of aspects 13-14 can be combined with any of aspects 1-12, 15-16, or 17-18. Further, any of aspects 15-16 can be combined with any of aspects 1-12, 13-14, or 17-18 and any of aspects 17-18 can be combined with any of aspects 1-12, 13-14, or 15-16.

Aspect 1. A fan assembly, comprising:

an impeller including a plurality of blades, the impeller having an impeller diameter;

a duct configured to receive an outflow provided by the impeller, the duct having a duct exit diameter that is larger than the impeller diameter; and a diffuser collar extending from the impeller toward a duct exit and configured and arranged to radially expand the outflow provided by the impeller, the diffuser collar having a first diameter at a first edge disposed a first distance from the impeller and a contour extending from the first edge toward a second edge having a second diameter, the second edge disposed a second distance from the impeller, wherein the first distance is smaller than the second distance, the first diameter is smaller than the second diameter, and the first and second diameters are smaller than the duct exit diameter.

Aspect 2. The fan assembly according to aspect 1, wherein the first diameter is substantially similar to the impeller diameter.

Aspect 3. The fan assembly according to any of aspects 1-2, wherein the contour of the diffuser collar extending from the first edge toward the second edge is linear.

Aspect 4. The fan assembly according to any of aspects 1-3, further comprising:

another diffuser collar configured to radially expand the outflow provided by the impeller, the another diffuser collar having a third diameter at a third edge disposed a third distance from the impeller and a contour extending from the third edge toward a fourth edge having a fourth diameter, the fourth edge disposed a fourth distance from the impeller, wherein the third distance is smaller than the fourth distance, the third diameter is smaller than the fourth diameter, and the third and fourth diameters are smaller than the duct exit diameter.

Aspect 5. The fan assembly according to aspect 4, wherein the third and fourth diameters of the another diffuser collar are smaller than the first and second diameters of the diffuser collar.

Aspect 6. The fan assembly according to aspect 5, wherein the diffuser collar and the another diffuser collar are concentrically arranged around a rotation axis of the impeller.

Aspect 7. The fan assembly according to any of aspects 4-6, further comprising:

a plurality of vane diffusers extending radially from a rotation axis of the impeller, the plurality of vane diffusers configured to diffuse a circumferential velocity of the outflow.

Aspect 8. The fan assembly according to aspect 7, wherein the plurality of vane diffusers is mounted to at least one of the diffuser collar and the another diffuser collar.

Aspect 9. The fan assembly according to any of aspects 7-8, wherein the plurality of vane diffusers is contoured to increase an axial component of a velocity of the outflow provided by the impeller.

Aspect 10. The fan assembly according to any of aspects 7-9, wherein the diffuser collar, the another diffuser collar, and the plurality of vane diffusers are configured to withstand a force directed toward the impeller.

Aspect 11. The fan assembly according to any of aspects 6-10, wherein the diffuser collar and the another diffuser collar are configured to be mounted to a fan grille that is disposed a fifth distance from the exit of the impeller, the fifth distance being greater than the second distance.

Aspect 12. The fan assembly according to any of aspects 4-11, wherein the diffuser collar and the another diffuser collar have a different contour.

Aspect 13. A method of assembling a diffuser collar apparatus in a fan system, comprising:

providing an axial fan having a duct with a duct exit of a larger diameter than an impeller of the axial fan; and providing a diffuser collar at a duct exit having a variable diameter for radially expanding an outflow from the impeller of the axial fan to the duct exit.

Aspect 14. The method according to aspect 13, further comprising:

mounting the diffuser collar to the duct outlet and a fan grate, the fan grate configured to prevent contact with a moving part of the axial fan.

Aspect 15. A method of assembling a diffuser collar apparatus in a fan system, comprising:

providing an axial fan having a duct with a duct exit of a larger diameter than an impeller of the axial fan; and providing a plurality of concentrically spaced diffuser collars having variable diameters at the duct exit for radially expanding an outflow from the impeller of the axial fan out of the duct exit.

Aspect 16. The method according to aspect 15, further comprising providing a plurality of vane diffusers extending radially from an axis of rotation of the impeller, the plurality of vane diffusers configured to diffuse a circumferential velocity of the outflow.

Aspect 17. A method of controlling an outflow of an axial fan, comprising:

providing an axial fan having a duct with a duct exit of a larger diameter than an impeller of the axial fan; and providing a plurality of concentrically spaced diffuser collars having variable diameters at the duct exit for radially expanding an outflow from the impeller of the axial fan out of the duct exit.

Aspect 18. The method according to aspect 17, further comprising providing a plurality of vane diffusers extending radially from an axis of rotation of the impeller, the plurality of vane diffusers configured to diffuse a circumferential velocity of the outflow.

The terminology used in this Specification is intended to describe particular embodiments and is not intended to be limiting. The terms "a," "an," and "the" include the plural forms as well, unless clearly indicated otherwise. The terms "comprises" and/or "comprising," when used in this Specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. The word "embodiment" as used within this Specification may, but does not necessarily, refer to the same embodiment. This Specification and the embodiments described are exemplary only. Other and further embodiments may be devised without departing from the basic scope thereof, with the true scope and spirit of the disclosure being indicated by the claims that follow.

What is claimed is:

1. A fan assembly for a condenser fan of a heating, ventilation, and air conditioning (HVAC) system, comprising:

an impeller including a plurality of blades, each of the blades including a blade tip, the impeller having an impeller diameter;

a duct configured to receive an outflow provided by the impeller, the duct having a duct exit diameter that is larger than the impeller diameter; and a diffuser collar extending from the blade tips of the impeller on an outflow side of the impeller toward a duct exit and configured and arranged to radially expand the outflow provided by the impeller, the diffuser collar having a first diameter at a first edge disposed at the blade tips of the impeller on the outflow side of the impeller and a contour extending from the first edge toward a second edge having a second diameter, the second edge disposed a distance from the impeller, wherein the first diameter is smaller than the second diameter, the first and second diameters are smaller than the duct exit diameter, and the first diameter is smaller than the impeller diameter, such that during operation, the impeller rubs away a portion of the diffuser collar.

2. The fan assembly according to claim 1, wherein the contour of the diffuser collar extending from the first edge toward the second edge is linear.

3. The fan assembly according to claim 1, further comprising:

another diffuser collar configured to radially expand the outflow provided by the impeller, the another diffuser collar having a third diameter at a third edge disposed at the blade tips of the impeller on the outflow side of the impeller and a contour extending from the third edge toward a fourth edge having a fourth diameter, the fourth edge disposed the distance from the impeller, wherein the third diameter is smaller than the fourth diameter, and the third and fourth diameters are smaller than the duct exit diameter.

4. The fan assembly according to claim 3, wherein the third and fourth diameters of the another diffuser collar are smaller than the first and second diameters of the diffuser collar.

5. The fan assembly according to claim 4, wherein the diffuser collar and the another diffuser collar are concentrically arranged around a rotation axis of the impeller.

6. The fan assembly according to claim 3, further comprising:

a plurality of vane diffusers extending radially from a rotation axis of the impeller, the plurality of vane diffusers configured to diffuse a circumferential velocity of the outflow.

7. The fan assembly according to claim 6, wherein the plurality of vane diffusers is mounted to at least one of the diffuser collar and the another diffuser collar.

8. The fan assembly according to claim 6, wherein the plurality of vane diffusers is contoured to increase an axial component of a velocity of the outflow provided by the impeller.

9. The fan assembly according to claim 6, wherein the diffuser collar, the another diffuser collar, and the plurality of vane diffusers are configured to be a fan grille structure that withstands a force directed toward the impeller.

10. The fan assembly according to claim 3, wherein the diffuser collar and the another diffuser collar have a different contour.

11. A method of assembling a diffuser collar apparatus in a fan system, comprising:

providing an axial fan having a duct with a duct exit of a larger diameter than an impeller of the axial fan, the axial fan including an impeller having a plurality of blades, each of the blades having a blade tip; and providing a diffuser collar at a duct exit having a variable diameter for radially expanding an outflow from the impeller of the axial fan to the duct exit, the diffuser collar having a diameter that is smaller than a diameter of the impeller of the axial fan, such that during operation, the impeller rubs away a portion of the diffuser collar, the diffuser collar being disposed such that the diffuser collar extends from the blade tips of the impeller on an outflow side of the impeller.

12. The method according to claim 11, further comprising:

mounting the diffuser collar to the duct outlet and a fan grille, the fan grille configured to prevent contact with a moving part of the axial fan.

13. The method according to claim 11, further comprising:

providing another diffuser collar at the duct exit having a variable diameter for radially expanding the outflow from the impeller of the axial fan to the duct exit, wherein the another diffuser collar is concentrically arranged with the diffuser collar.

14. The method according to claim 13, further comprising:

providing a plurality of vane diffusers extending radially from an axis of rotation of the impeller, the plurality of vane diffusers configured to diffuse a circumferential velocity of the outflow.

* * * * *